United States Patent [19]

Blanco

[11] Patent Number: 4,479,311

[45] Date of Patent: Oct. 30, 1984

[54] HAIR REMOVING APPARATUS

[76] Inventor: David M. Blanco, 1840 Virginia La., Billings, Mont. 59102

[21] Appl. No.: 441,259

[22] Filed: Nov. 12, 1982

Related U.S. Application Data

[63] Continuation-in-part of Ser. No. 228,766, Jan. 27, 1981, abandoned.

[51] Int. Cl.[3] ..... A45D 20/10

[52] U.S. Cl. ..... 34/90; 34/91; 34/97

[58] Field of Search ..... 34/96, 97, 92, 90, 91; 15/344; 219/373, 370, 371; 132/9, 11

[56] References Cited

U.S. PATENT DOCUMENTS

| | | | |
|---|---|---|---|
| 828,439 | 8/1906 | Strunsky | 34/97 |
| 1,308,685 | 7/1919 | DiSalvio | 34/97 |
| 2,753,434 | 7/1956 | Storm, Jr. | 34/97 |
| 2,974,346 | 3/1961 | Hahn . | |
| 3,048,876 | 8/1962 | Kemnitz | 15/421 |
| 3,440,681 | 4/1969 | Hixson et al. | 15/339 |

FOREIGN PATENT DOCUMENTS

| | | | |
|---|---|---|---|
| 582831 | 10/1958 | Italy | 34/97 |

*Primary Examiner*—Larry I. Schwartz
*Attorney, Agent, or Firm*—Arthur L. Urban

[57] ABSTRACT

Hair removing apparatus for a hand held hair dryer including a housing with an air inlet opening therein, the hair removing apparatus including a body portion, a dryer connecting portion, a hair collecting portion and a hair pickup portion; the body portion including a rigid tubular member with open ends and a substantially straight passage therethrough; the dryer connecting portion including adapter mechanism disposed adjacent one end of the tubular member, the adapter mechanism including a resilient section capable of mating with the periphery of the air inlet opening of the dryer housing; the hair collecting portion including an air permeable flexible filter bag disposed across and within the passage through the tubular member and extending substantially the full length of the body portion, the filter bag including a rigid ring member disposed adjacent and circumscribing the opening thereof, the ring member being engageable with the end of the tubular member remote from the dryer connecting portion, mechanism for maintaining the filter bag properly oriented with respect to the passage including filter support mechanism disposed across the tubular member passage adjacent the dryer connecting portion; the hair pickup portion being rigidly connected directly to the end of the tubular member remote from the dryer connecting portion, the hair pickup portion including an end section separable from the tubular member, the end section having a tubular configuration adjacent to the tubular member for connection thereto and tapering to a slot configuration adjacent the free end thereof, the slot end of the end section including a soft resilient surface.

4 Claims, 5 Drawing Figures

FIG. 1
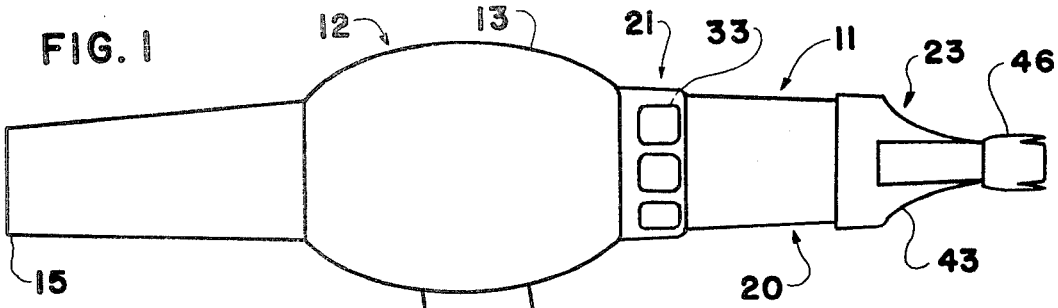
FIG. 2
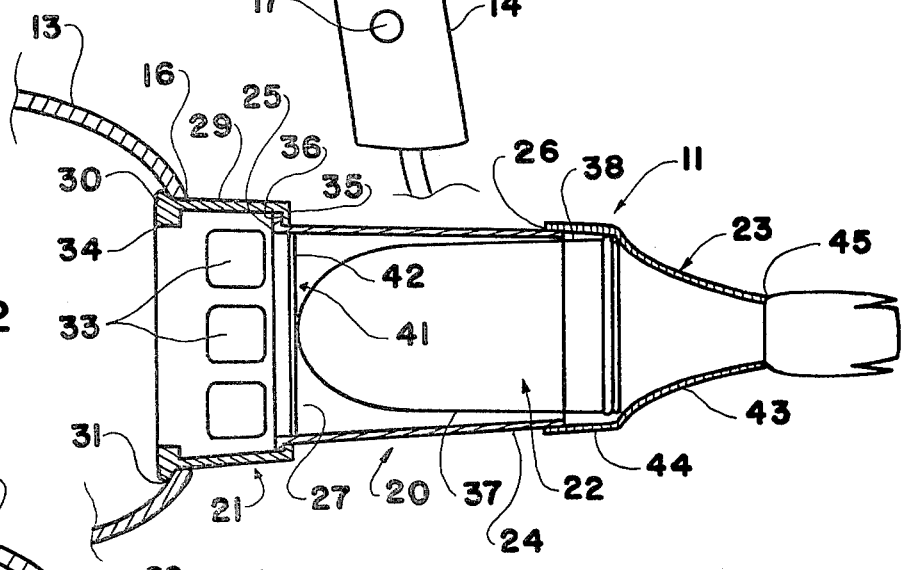
FIG. 3
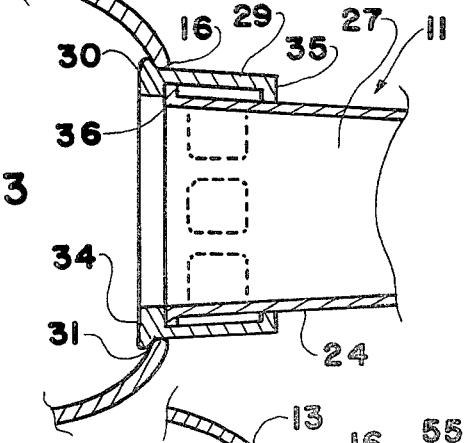
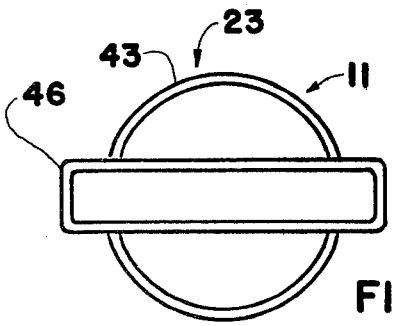
FIG. 4
FIG. 5
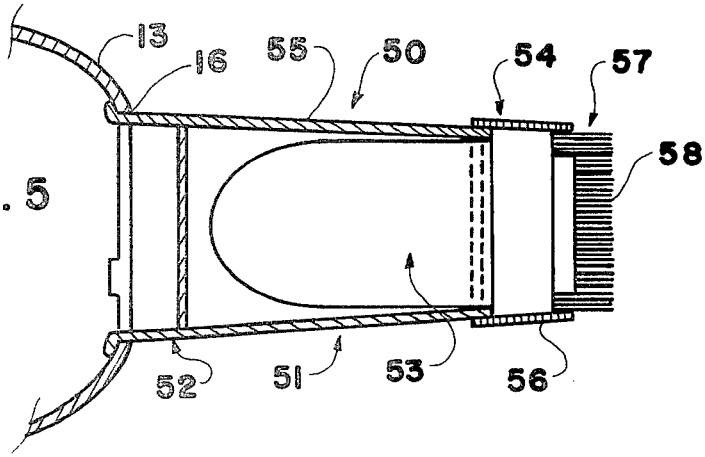

HAIR REMOVING APPARATUS

This application is a continuation-in-part of pending application Ser. No. 228766, filed Jan. 27, 1981 now abandoned.

This invention relates to a novel hair removing apparatus and more particularly relates to a new hair removing and collecting apparatus.

Loose hair on a person's body and/or clothes is a problem for most people. This is because all human beings lose hair continuously all of their lives. For most people, hair loss is at a slow rate so the hairs that fall from their heads ordinarily are not readily apparent on their bodies or clothes.

However, on some occasions, the quantity of loose hair may be much greater than at other times. For example, when a person gets his hair cut, there are a large number of loose hairs on his body and clothes. Hair cutting establishments such as hair styling salons, barber and beauty shops and the like are aware of this problem and go to considerable efforts to eliminate the presence of hair on their clients. Cloth or plastic coverings are wrapped around the client's neck and draped over the upper torso. While most of the cut hair falls onto the covering, some hair may slip down around the client's neck. Also, some hair may fall onto the client's clothes if the covering is not removed with a high degree of care.

Another means for removing cut hair employed by some establishments is a central vacuum or air pressure system with outlets at each of the operator's stations. While such systems are useful, they are very costly and are not suitable for establishments which have only a few operator's stations.

In view of the above problems with removing hair from one's body and clothes after a haircut, many people try to schedule their haircuts so they can go home immediately after the haircut to bathe or shower and change their clothes so the discarded clothes can be cleaned. Although such a procedure achieves the desired hair removal, it is a time-consuming task considered by most persons to be a necessary nuisance. Many people wish that there were another less objectionable way of removing hair after a haircut and also on other occasions.

The present invention provides a novel apparatus for removing loose hair. The apparatus of the invention provides an inexpensive way to remove loose hair. The apparatus removes and collects hair quickly and conveniently. The apparatus is useful in a wide variety of everyday situations as well as after haircutting.

The hair removing apparatus of the invention is simple in design and can be manufactured relatively inexpensively. The apparatus can be fabricated from commercially available materials and components using conventional manufacturing techniques. The apparatus is durable in construction and has a long useful life without maintenance.

The hair removing apparatus of the invention is convenient to use. The apparatus can be cleaned of collected hair easily. Moreover, the apparatus has ample storage for the collected hair so that cleaning of the device is required infrequently.

Other benefits and advantages of the novel hair removing apparatus of the present invention will be apparent from the following description and the accompanying drawings in which:

FIG. 1 is a side elevation partially in section of one form of the hair removing apparatus of the invention mounted on a hand held hair dryer;

FIG. 2 is an enlarged fragmentary side view in section of the hair removing apparatus shown in FIG. 1 in a hair removing position;

FIG. 3 is an enlarged fragmentary side view in section of the hair removing apparatus shown in FIG. 1 in a hair drying position;

FIG. 4 is a right end view of the hair removing apparatus shown in FIG. 1; and

FIG. 5 is a side elevation in section of another form of the hair removing apparatus of the invention.

As shown in the drawings, one form of the novel hair removing apparatus 11 of the present invention is connected to a hand held hair dryer 12. The hair dryer 12 includes a housing 13 with a handle 14. The dryer 12 also includes a nozzle 15 from which hot air is blown and an air inlet 16. The hair dryer 12 further includes a fan and heating means (not shown) disposed in a passage connecting the air inlet 16 with the outlet nozzle 15. An electrical switch 17 for activation of the heating means and fan may be located in the handle 14.

The hair removing apparatus 11 of the invention includes a body portion 20, a dryer connecting portion 21, a hair collecting portion 22 and a hair pickup portion 23. The body portion 20 includes a tubular member 24 with open ends 25 and 26. The tubular member 24 includes a substantially straight passage 27 therethrough extending between the ends 25 and 26.

The dryer connecting portion 21 of the hair removing apparatus 11 includes adapter means 29. The adapter 29 is disposed adjacent one end of the tubular member 24. The adapter 29 includes resilient means such as finger sections 30 capable of mating with the periphery 31 of the air inlet opening 16 of the dryer housing 13.

The adapter 29 preferably is separable from the body portion 20. Advantageously, the tubular member 24 is slidable with respect to the adapter 29. The adapter 29 preferably includes a plurality of sidewall openings 33.

In addition, the adapter 29 may include stop sections 34 and 35 disposed adjacent the ends thereof. The stop sections 34 and 35 facilitate captively retaining a flange section 36 of the tubular member 24.

The hair collecting portion 22 of the apparatus 11 of the invention includes an air permeable flexible filter bag 37. The filter bag 37 is disposed across the passage 27 of the tubular member 24. As shown, the filter bag 37 is disposed within the passage through the tubular member and extends substantially the full length of the body portion 20.

The filter bag 37 includes a rigid ring member 38. The ring member 38 is disposed adjacent the opening 39 of the bag and circumscribes same. The ring member 38 is of a configuration to be engageable with the end 26 of the tubular member 24 that is remote from the dryer connecting portion 21.

The hair collecting portion 22 further includes means for maintaining filter bag 37 properly oriented with respect to tubular member 24. Such means includes filter support means 41. The filter support 41 is disposed across passage 27 of the tubular member 24 at a point adjacent the dryer connecting portion 21. The filter support 41 advantageously includes at least one bar member 42 extending transversely of the passage 27.

The hair pickup portion 23 of the apparatus 11 is rigidly connected directly to the end 26 of the tubular member 24, that is, the end thereof remote from the dryer connecting portion 21. The hair pickup portion 23 includes an end member 43 that is separable from the tubular member 24 to facilitate changing of the filter bag 37. The end member 43 has a tubular or cylindrical configuration 44 adjacent to the tubular member 24 for connection thereto. Also, the end member 43 tapers from the cylindrical configuration 44 to a slot configuration 45 adjacent the free end of the end member.

The slot end 45 of the end member 43 includes a soft resilient surface. The resilient surface advantageously may include a peripheral rubber surface 46 as shown in FIGS. 1–4. The resilient surface also may include brush means such as shown in FIG. 5 as will be described hereinafter.

FIG. 5 illustrates another form of the novel hair removing apparatus 50 of the present invention. As shown, the apparatus 50 includes a body portion 51, a dryer connecting portion 52, a hair collecting portion 53 and a hair pickup portion 54.

The body portion 51 and the hair collecting portion 53 are similar to the respective body portion 20 and the hair collecting portion 22 of the hair removing apparatus 11 described in detail above. The dryer connecting portion 52 differs from the dryer connecting portion 21 in that the connecting portion 52 does not include any sidewall openings and is integrally formed with tubular member 55.

The hair pickup portion 54 differs from the pickup portion 23 of apparatus 11 above in several respects. The pickup portion 54 includes an end member 56 that has a generally cylindrical configuration throughout its length. Also, resilient end surface 57 includes a circular brush 58.

In the use of the novel hair removing apparatus 11 of the present invention as shown in FIGS. 1–4 of the drawings, the apparatus 11 first is assembled. The dryer connecting portion 21 of the apparatus 11 is combined with the tubular member 24 by inserting the flange section 36 on the end 25 of the tubular member into the adapter 29 so the flange section 36 is retained between the stop sections 34 and 35 of the adapter.

The dryer connecting portion 21 then is attached to the air inlet opening 16 of the dryer housing 13. This is accomplished by engaging resilient finger sections 30 with the periphery of the air inlet opening 16.

Thereafter, filter bag 37 may be inserted into the end 26 of the tubular member 24 and slid into passage 27 until ring member 38 contacts end 26. Then, the cylindrical end 44 of the end member 43 is slipped over the end of the tubular member and the ring member to provide a rigid connection therebetween. The dryer 12 with the hair removing apparatus 11 affixed thereto now is ready for use.

The hair remover/dryer combination is used by activating switch 17 to actuate the heater and fan of the dryer 12. The fan draws air into air inlet 16 and blows it from the nozzle 15.

To use the dryer 12 for drying hair, the tubular member 24 is pulled to an extended position with respect to the dryer. In this position, the flange section 36 bears against the stop section 35 of the adapter 29. The sidewall openings 33 in the adapter 29 are clear so air is drawn into the dryer through the openings.

When it is desired to use the dryer to remove loose hair, the tubular member 24 is pushed to a retracted position in which the flange section 36 of the tubular member bears against the stop section 34 of the adapter 29. In this position, the sidewall openings 33 of the adapter 29 are blocked by the tubular member so that air can only be drawn into the dryer 12 through the hair removing apparatus 11.

By placing the resilient end surface 46 of the pickup portion 23 adjacent to loose hair such as cut hair on the clothes or body of an individual, hair is drawn through end member 43 and into filter bag 37. The hair is collected in the bag while the air passes through the bag, into the dryer 12 and is expelled from nozzle 15.

When it is desired to use the dryer 12 for drying hair again, the tubular member 24 is pulled to an extended position again, clearing sidewall openings 33 so that air will be drawn through the openings rather than through the hair removing apparatus 11.

When bag 37 becomes full of hair, the apparatus 11 may be cleaned by removing end member 43 from tubular member 24 to provide access to the bag. The bag 37 may be removed and discarded or cleaned and replaced. The bag 37 may then be positioned in member 24 and end member 43 slipped over the end of tubular member 24 to secure the bag in place. The apparatus can be used again as it was initially.

In the use of the hair removing apparatus shown in FIG. 5, the apparatus 50 is attached to air inlet opening 16 of dryer 12. This is accomplished by mating finger sections 30 of adapter 52 with the periphery of the inlet. A filter bag 37 is inserted into tubular member 55 and end member 56 placed thereover. The apparatus 50 is used to vacuum loose hair as described above. When it is desired to use dryer 12 for drying hair, the apparatus 50 simply is removed from the dryer so that it can be used in the normal way.

The above description and the accompanying drawings show that the present invention provides a novel apparatus for removing loose hair from clothes, the body or other surfaces. The hair removing apparatus of the invention is convenient to use and removes and collects hair rapidly. The apparatus also is useful for the removal of other materials such as lint and other foreign matter.

The hair removing apparatus of the invention can be cleaned easily without special tools or dexterity. The apparatus has ample storage capacity so it needs to be cleaned only infrequently.

The apparatus of the invention is simple in design and can be manufactured relatively inexpensively. The apparatus can be fabricated from commercially available materials and components employing conventional dryer manufacturing techniques.

It will be apparent that various modifications can be made in the particular hair removing apparatus described in detail above and shown in the drawings within the scope of the invention. The size, configuration and arrangement of components can be changed for specific brands of dryers and/or operating conditions. Also, the filter bag, the soft resilient end surface and the like can be different if desired. In addition, the dryer connecting portion can be permanently affixed to the dryer air inlet or internally formed therewith. These and other changes can be made in the hair removing apparatus of the invention provided the functioning and operation thereof are not adversely affected. Therefore, the scope of the invention is to be limited only by the following claims.

What is claimed is:

1. Hair removing apparatus for a hand held hair dryer including a housing with an air inlet opening therein, said hair removing apparatus including a body portion, a dryer connecting portion, a hair collecting portion and a hair pickup portion; said body portion including a rigid tubular member with open ends and a substantially straight passage therethrough, said tubular member including a flange section disposed adjacent an end thereof closest to said dryer connecting portion; said dryer connecting portion including adapter means disposed adjacent one end of said tubular member and being slidable with respect thereto, said dryer connecting portion including a plurality of sidewall openings, said adapter means including stop sections disposed adjacent ends thereof to captively retain said flange section of said tubular member, said adapter means including resilient means capable of captively mating with the periphery of said air inlet opening of said dryer housing; said hair collecting portion including an air permeable flexible filter bag disposed across and within said passage through said tubular member and extending substantially the full length of said body portion, said filter bag including a rigid ring member disposed adjacent and circumscribing the opening thereof, said ring member being engageable with the end of said tubular member remote from said dryer connecting portion, means for maintaining said filter bag properly oriented with respect to said passage including filter support means disposed across said tubular member passage adjacent said dryer connecting portion; said hair pickup portion being rigidly connected directly to the end of said tubular member remote from said dryer connecting portion, said hair pickup portion including an end member separable from said tubular member, said end member having a tubular configuration adjacent to said tubular member for connection thereto and tapering to a slot configuration adjacent the free end thereof, said slot end of said end member including a soft resilient surface, whereby attaching said connecting portion of said hair removing apparatus to the air inlet opening of a hand held hair dryer which is operating and holding said hair pickup portion of said apparatus adjacent to loose hair, will draw the hair into said pickup portion and collect the hair in said collecting portion when the sidewall openings in the dryer connecting portion are covered by the tubular member.

2. Hair removing apparatus according to claim 1 wherein said filter support means includes at least one bar member disposed transversely of said tubular member passage.

3. Hair removing apparatus according to claim 1 wherein said soft resilient surface of said hair pickup portion includes a peripheral rubber section.

4. Hair removing apparatus according to claim 1 wherein said soft resilient surface of said hair pickup portion includes brush means.

* * * * *